United States Patent [19]

McMahon

[11] Patent Number: 4,986,054

[45] Date of Patent: Jan. 22, 1991

[54] FILL TUBE SPREADER

[75] Inventor: Michael J. McMahon, Palatine, Ill.

[73] Assignee: Zip-Pak Incorporated, Northbrook, Ill.

[21] Appl. No.: 380,485

[22] Filed: Jul. 17, 1989

[51] Int. Cl.[5] ..... B65B 9/08; B65B 9/20

[52] U.S. Cl. ..... 53/451; 53/552

[58] Field of Search ..... 53/260, 261, 451, 551, 53/552, 553, 554, 576, 450

[56] References Cited

U.S. PATENT DOCUMENTS

| | | | |
|---|---|---|---|
| 3,470,672 | 10/1969 | Tuma | 53/551 X |
| 3,538,676 | 11/1970 | Runo et al. | 53/552 |
| 3,681,890 | 8/1972 | Pringle et al. | 53/552 X |
| 3,681,892 | 8/1972 | Safranski | 53/551 |
| 3,779,836 | 12/1973 | Henry et al. | 53/551 X |
| 3,815,317 | 6/1974 | Toss | 53/451 |
| 4,127,976 | 12/1978 | Jablonski et al. | 53/551 X |
| 4,129,976 | 12/1978 | Gründler et al. | 53/552 |
| 4,355,494 | 10/1982 | Tilman | 53/451 X |
| 4,633,654 | 1/1987 | Sato et al. | 53/551 X |

*Primary Examiner*—Robert L. Spruill
*Assistant Examiner*—Linda B. Johnson
*Attorney, Agent, or Firm*—Hill, Van Santen, Steadman & Simpson

[57] ABSTRACT

A method and apparatus for forming bags, such as from a continuous sheet of thermoplastic film fed forwardly and wrapped over a forming tube with the contents being filled into the bag through the tube and the end of the film formed into a bag tube being cross-sealed. The lower end of the filling tube is constructed so as to elastically deform and spread as sealing members move in laterally and thereby spread and flatten the tube to insure the making of a seal which is devoid to wrinkles and leakage possibilities.

8 Claims, 1 Drawing Sheet

FILL TUBE SPREADER

BACKGROUND OF THE INVENTION

The present invention relates to improvements in methods and apparatus for making bags, and more particularly to using a forming, filling and sealing method where a continuous sheet of plastic is fed downwardly over a filling tube and filled and cross-sealed.

A common method of making bags, such as of thermoplastic containing product materials is by use of vertical forming, filling and sealing apparatus. Such apparatus takes a continuous flat sheet of plastic material which is fed forwardly and passed downwardly over a shaping shoulder and then shaped into tubular form by being wrapped around a vertical forming axis. The edges of the sheet are joined, such as by heat sealing them to each other or by being attached by joining continuous zipper strips which are secured to the edges of the sheet.

A product to be contained in the bag, such as a foodstuff, is introduced by dropping through the filling tube to be discharged at the opening into the tubular formed thermoplastic. The sheet is pulled downwardly over the filling tube in bag lengths, and as the contents are dropped into the bag through the filling tube, a cross-seal is formed above the contents and the preformed bag is cut from the bottom. The cross-seal then closes the plastic bag tube so that contents can be dropped for another bag. Earlier forms of such mechanism are shown in U.S. Pat. Nos. 3,815,317 and 4,355,494.

It is important in the formation of the bag that the cross-seams be leak-proof so as to protect the bag contents. It is also desirable, particularly where a transparent or highly visible plastic is employed, to form a cross-seal which is not replete with wrinkles and which preferably is wrinkle-free. This is desirable from an appearance standpoint, but also from the standpoint of insuring that the cross-seaming apparatus does not engage bunched up or wrinkled material and adversely affect the uniformity of the seam across the tubular sheet material.

As the cross-seal is formed and a completed bag is cut off of the length of tubing, contents are dropped through the filling tube down into the cross-sealed end. The exposed film can be slit of punctured as the sharp product rubs the film during the fall when the product impacts against the film. Any puncturing or damage to the film would not be tolerable because it would create a defective leaking package.

It is accordingly an object of the present invention to provide an improved method and apparatus for forming bags in a form, fill and seal operation wherein cross-seams can be effectively and efficiently made to achieve a seam on a bag which is essentially free of wrinkles and has a good appearance.

A further object of the invention is to provide a method and apparatus for cross-seaming bags in a form, fill and seal machine wherein the completed bag is more attractive and better made than with methods and apparatus heretofore available.

A still further object of the invention is to provide an improved method of making cross-seams on bags in a form, fill and seal machine wherein the apparatus is relatively simple in construction and reliable in operation.

It is a further object of the invention to provide an improved method and apparatus for making and filling bags in a vertical form, fill and seal machine wherein the possibility of damage to the package from the product being dropped against the film during filling is eliminated.

SUMMARY OF THE INVENTION

In accordance with one aspect of the present invention, there is provided a mechanism and method used in conjunction with a conventional form, fill and seal machine. The arrangement accomplishes providing a cross-seal laterally of the forming axis at the lower end of the tubular formed sheet. By providing a lower end extension on the filling tube, which extension is elastically collapsible and has a dimension to fill the tube, the tube will exert a continuing circumferential force on the tubular shaped sheet so that the sheet will stay wrinkle-free at the location of the cross-seam. The filling tube extension is located so that its lower end is directly above the seam which is formed. Wings, which are tapered outwardly and upwardly, engage the collapsible extension aiding in holding the tubular sheet material smooth and aiding in guiding it to the shape which it needs in order to form a satisfactory cross-seal. A fin projects from the sides of the collapsible extension so as to insure spreading uniformly in the correct direction.

The present invention contemplates the provision of a boot which acts as a film protector at the lower end of the filling tube. This film protector spreads the tucks out of the film but also functions as a product arrestor. The benefit of the product arrestor is that the product will hit the boot when the product falls down the tube during the bag filling cycle instead of hitting the film. The boot thereby protects the film from being punctured by sharp products on impact. These sharp products can take various forms depending on the contents with which the bag is to be filled and, for example, in packaging foodstuffs, frozen objects can puncture the film in the absence of the provision of the boot as provided in accordance with the present invention.

Other objects, advantages and features will become more apparent with the teaching of the principles of the invention in connection with the disclosure of the preferred embodiments thereof, in which:

DESCRIPTION OF THE PREFERRED EMBODIMENT

Figure 1:
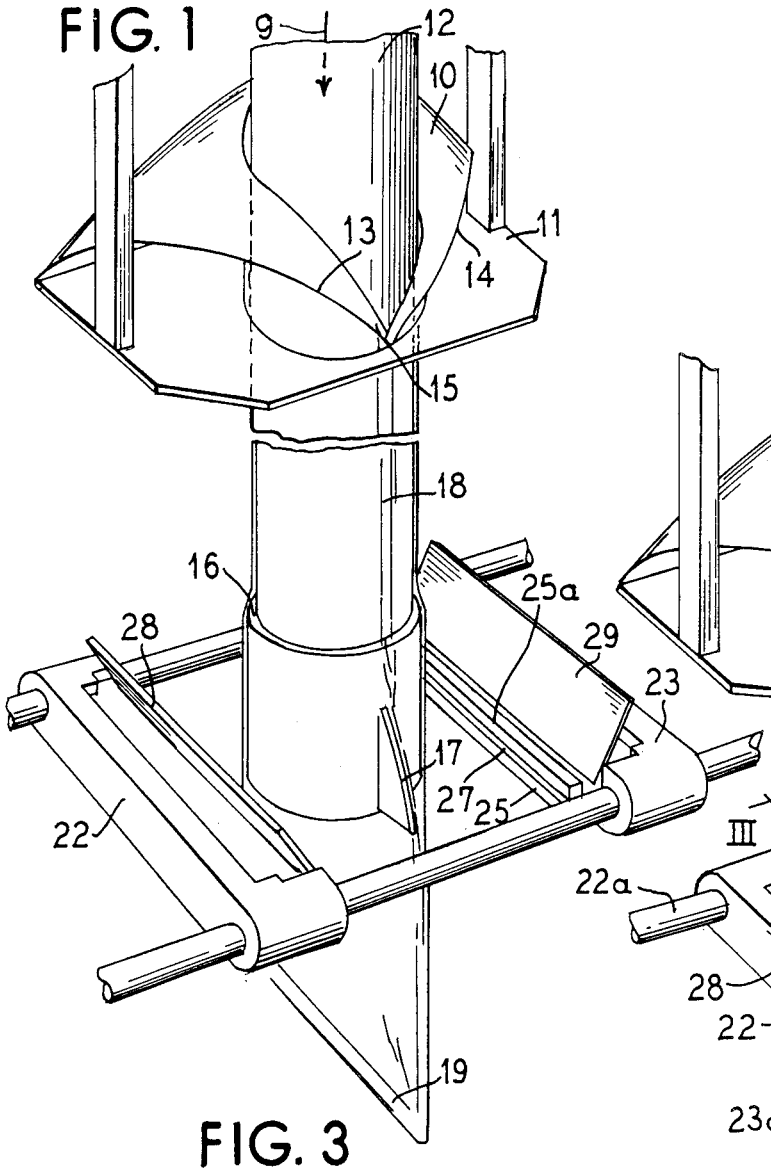
FIG. 1 is a perspective view of a form, filling and sealing machine with portions of the machine omitted, but illustrating exemplary structure of the invention for forming the cross-seal at the bottom of the plastic bag tube.

As illustrated in FIG. 1, a continuous sheet of bag material 10, such as a thermoplastic such as polyethylene, is fed continuously forwardly and shaped over the outer surface of a filling tube 12. For aiding in the shaping, a forming collar, shown partially at 11, is positioned to guide the plastic film onto the filling tube 10 and cause it to wrap over the outer surface of the tube into tubular bag shape. The edges 13 and 14 of the film are brought together such as at 15 and joined to each other to form a vertical seam 18. Suitable joining means are provided, not shown. If the film is merely used with raw edges, a vertical heat seam may be formed. If a reclosable bag is to be manufactured, the edges of the film 10 may be supplied in advance with mating fastener strips or the fastener strips may be attached as the edges are brought together.

The tubular shaped bag material with the edge seam 18 is drawn downwardly in steps so that with each step, a cross-seam can be formed to complete a bag. Cross-seam forming members 22 and 23 reciprocate back and forth to clamp against the bag tube and form the cross-seam.

As illustrated in FIG. 1, the tubular bag has been formed with a cross-seam 19 previously formed on the lower end. Contents are then fed downwardly dropped into the bag and the sealing jaws 22 and 23 are brought together to form the cross-seam. The bag is advanced in steps by being pulled down by other apparatus, not shown, or by the jaws 22 and 23 so constructed so that as they are clamped together, they are moved downwardly to pull a fresh supply of bag material downwardly. As illustrated, the jaws 22 and 23 are mounted for reciprocal movement laterally of the vertical forming axis on guide rods 22*a* and 23*a*, FIG. 2.

As the bag tube is pulled downwardly the length of a bag, the bag tube is then ready for the cross-seam. An important feature of the invention is that the thin plastic material of the bag tube is flattened and extended laterally so that a cross-seam can be formed without puckers or wrinkles. The bag material is often a thin thermoplastic, possibly on the order of several thousandths thick, and in high speed manufacturing operation, it is difficult to avoid the formation of wrinkles and puckers and to insure flattening of the tube so that heat sealing bars can be pressed against the tube. In addition to avoiding wrinkles, it is essential that the material be flattened to form the cross-seam in a manner so that bunches or gathers of the plastic material do not remain in the path of the sealing bars to require more sealing heat. If the sealing bars are presented only with smooth opposed layers of facing thermoplastic, a limited quick heat can be applied to form a reliable seal. The bars do not have to be left in place long enough to transmit heat to multiple layers as is the case if wrinkles are permitted to remain. This, in addition to insuring formation of a reliable seam, permits speeding up the manufacturing operation.

The uniquely constructed sealing bars have laterally extending sealing plates 25 and 25*a* for the bar 23 and 24 and 24*a* for the bar 22. Between the plates are cutting knives, not shown, but located in the laterally extending grooves 26 and 27 between the bars. The reason the bars are separated is that when they are moved together, they simultaneously form the top seam for the previous bag and the bottom seam for the succeeding bag. The knives in the spaces 26 and 27 sever the lower bag from the bag tube and the bag which has been previously filled through the filling tube drops off of the supply. The seam formed by the upper bars 24*a* and 25*a* provides the bottom of the bag tube for holding the next discharge of bag contents which is dropped through the filling tube 12.

After the bag tube has been pulled downwardly and the contents have been dropped, the seaming jaws 22 and 23 are moved together. The tubular bag material has begun to be shaped by laterally extending fins 17 diametrically opposed and located to extend in the direction of the vertical forming axis and positioned diametrically opposite each other on an extension 16 at the lower end of the filling tube. These fins have an upper curved surface to gradually flatten and stretch the plastic film tube. Only one fin 17 is shown at the location of the vertical seam 18, but it will be understood that fins on opposite sides diametrically opposed may be employed. These fins cause the bag tube to initially pull taut around the lower extension 16 of the forming tube.

The lower extension is uniquely constructed being resiliently flexible. As the film is drawn tight by the fin 17, it begins to flatten the lower end of the resilient extension 16 which may also be called a boot. The extension may be of rubber or plastic or of a material suitable for withstanding heat and is hollow and cylindrical in shape. As the jaws move together to the position shown in FIG. 2, upper wing extensions 28 and 29, which flare upwardly and outwardly from the jaws, press the tubular bag material against the extension 16 to flatten the material. This also flattens the extension causing it to spread outwardly in a lateral direction of the fin 17 which is laterally transverse of the direction that the jaws are moving inwardly. The flattening of the tube tends to maintain the plastic film in a taut condition so that it remains flattened between the heated sealing jaws. This helps in insuring wrinkle-free seam formation.

The lower end of the extension 16 ends just above the top sealing bars 24*a* and 25*a* so that the flattened tubular bag material presents its outer surfaces to the sealing jaws in a stretched laterally flattened condition. The outwardly flaring shoulders 28 and 29 help flatten the extension 16 causing it to spread laterally to maintain the tubular film taut.

Figure 3:
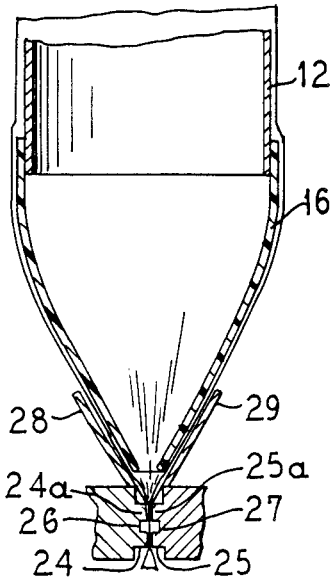
FIG. 3 is a fragmentary vertical sectional view taken substantially along line III—III of FIG. 2.

FIG. 3 shows the relationship of the sealing jaws and the film relative to the lower end of the extension 16 as the cross-seam is formed. The elastic extension 16 does not collapse but spreads out sideways to pull the plastic tube laterally taut.

Figure 2:
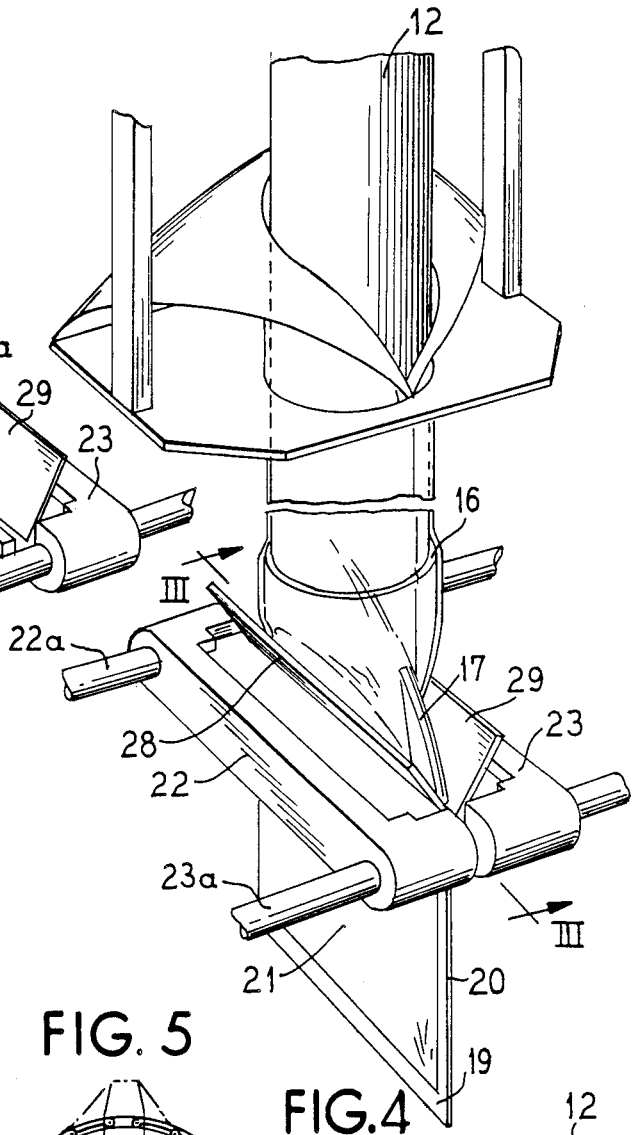
FIG. 2 is another perspective view of FIG. 1 showing the cross-seam being made.

FIG. 3 also illustrates the protective function of the extension or boot 16. During filling, equipment is provided shown schematically at 9 which drops a predetermined fill down through the filling tube 12 into the lower end of the bag. The contents being dropped descend and will impact the boot 16 rather than the thin fragile film outside of the boot. This permits the rapid filling of a great variety of contents including those which may have sharp points and edges. Of course, as the bag is then pulled downwardly, the boot releases the contents to rest in the base of the bag so that the bag can be completed by a cross-seam or seal created above the contents as is shown in FIG. 2 with the contents being located at 21 in the previously formed bag.

After the seam has been formed, as shown in FIG. 3, the jaws are pulled apart, and a new length of bag material is pulled downwardly whereupon the extension 16, being released by the shoulders 28 and 29, springs back to its original cylindrical shape.

Figure 5:
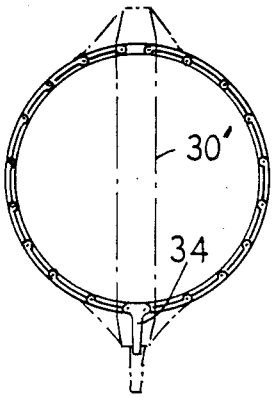
FIG. 5 is a vertical sectional view taken substantially along V—V of FIG. 4.
Figure 4:
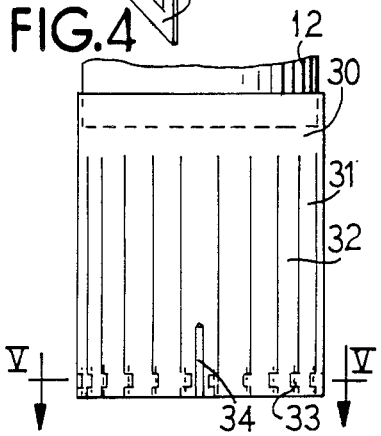
FIG. 4 is a fragmentary elevational view illustrating another form of the lower end of the filling tube.

FIGS. 4 and 5 illustrate another form of the invention wherein the filling tube 12 has an extension 30 at the lower end. The extension 30 is elastically resilient but not of rubber, being instead of a metal material with spring-like fingers 31 and 32 extending downwardly. These fingers have guides 33 at the lower end so that the edges can be hinged to each other and the extension 30 will be elongate at its lower end when the cross-seam is formed to the position shown at 30′ in FIG. 5. Again, as soon as the bag material is pulled downwardly, the extension will spring to its original cylindrical shape. A fin, such as shown at 34, is at the side of one of the spring fingers to aid in guiding the bag tube to a flattened shape.

The extension 30 of FIGS. 4 and 5 also acts as a boot to protect the fragile plastic film of the bag when contents are dropped down through the filling tube. As the contents are dropped from the location shown by the schematic arrow 9 in FIG. 1, they fall down against the inner surface of the boot 30 so that they do not directly impact the film. When the film is pulled downwardly to complete the bag, the contents will descend downwardly from the boot and rest in the bag.

In operation, a continuous sheet 10 of thermoplastic bag material is drawn downwardly over a filling tube 12 with edges 13 and 14 brought together and joined as at 15 to form a vertical seam 18. When the lower end of the tube has been filled with contents dropped through the tube 12, sealing jaws 22 and 23 move together. A lateral fin 17 starts flattening the bag tube and the shoulders 28 and 29 press against the sides of the cylindrical elastic extension 16 to flatten it and cause it to assume an oblong shape with its edges spreading to maintain the plastic tube taut. Contents are dropped down into the bag from the location shown at 9 in FIG. 1 and will drop down impacting the extension boot 16 rather than the film so that the film will not be injured. The sealing bars 24*a* and 24 and 25*a* and 25 which are heated by means, not shown, seal the layers of plastic film of the bag tube together and a cut is formed between the broad seam at 26 and 27 so that a completed bag drops off and the bottom of a succeeding bag is formed. The sealing jaws then pull the tube downwardly so that the contents which have been dropped into the interior of the extension boot 16 can fall down into the sealed end of the tube. The boot 10 tends to spring back to its original cylindrical shape as the film tube is pulled downwardly and the extension boot 16 is fully released when the sealing jaws 22 and 23 move away from the seam.

Thus, it will be seen that I have provided an improved structure and method of making bags which meets the objectives and advantages above set forth and forms an improved bag and is capable of use in an increased speed, increased reliability manufacturing operation.

I claim as my invention:

1. An apparatus for making bags comprising in combination:

a vertical forming and filling tube over which a continuous sheet of bag forming film is moved along a vertical forming axis and wrapped and shaped to tubular form;

a cross-sealing means for flattening the tubular form sheet at the lower end of the tube to form a cross-seal lateral of the forming axis;

and a flexible tube extension at the lower end forming a protective boot within the film tube for being impacted by contents dropped through the tube.

2. An apparatus for making bags constructed in accordance with claim 1:

wherein the boot is formed of a flexible plastic material which flattens as a cross-seam is formed.

3. An apparatus for making bags constructed in accordance with claim 1:

wherein the boot is formed of a tubular extension of the filling tube with separable fingers which interleave as the film tube is flattened.

4. In a form, fill and seal method of forming bags comprising the steps:

advancing a continuous sheet of bag material along a forming axis and shaping the sheet into tubular form around a filling tube;

joining the edges of the sheet to complete a tubular form;

forming a cross-seal laterally of the forming axis and pressing the tubular form flat along a first lateral axis;

simultaneously applying a spreading force to the tubular form at the cross-seal in a direction of a second lateral axis transverse to said first lateral axis so that the tubular form is spread evenly and smoothly at the seam; and a flexible support supporting the tubular form material internally immediately above the location of the cross-seal with the flexible support collapsing as the spreading force is applied so that the material is spread uniformly evenly at the cross-seal.

5. An apparatus for making bags comprising in combination:

a forming and filling tube over which a continuous sheet of bag forming material is moved along a forming axis and wrapped and shaped to tubular form;

a cross-sealing means for flattening the tubular form sheet at the lower end of the tube to form a cross-seal lateral of the forming axis;

and support means at the lower end of the tube holding the material relatively taut in the lateral direction at the seam so that a smooth wrinkle-free seam is formed;

said filling tube having a flexible portion at the lower end flattening transversely as the cross-sealing means flattens the sheet providing the support means for holding the material taut.

6. An apparatus for making bags constructed in accordance with claim 5:

including an extension on the lower end of said filling tube capable of lateral movement for spreading the sheet laterally of the forming axis and providing the support means as the cross-seal is formed.

7. An apparatus for making bags comprising in combination:

a forming and filling tube over which a continuous sheet of bag forming material is moved along a forming axis and wrapped and shaped to tubular form;

a cross-sealing means for flattening the tubular form sheet at the lower end of the tube to form a cross-seal lateral of the forming axis;

support means at the lower end of the tube holding the material relatively taut in the lateral direction at the seam so that a smooth wrinkle-free seam is formed;

and a lower extension on the filling tube including circumferentially divided sectors hingedly connected to each other to collapse as the cross-sealing means flattens the tubular formed sheet.

8. In a vertical form, fill and seal method of forming bags, the steps comprising:

advancing a continuous sheet of bag film material over a filling tube and shaping the sheet into tubular form;

joining the edges of the sheet to complete the tubular form;

forming a cross-seal laterally of the vertical forming axis of the tube and pressing the tubular form flat;

and locating a protective boot at the base of the filling tube within the film sheet to protect the film as contents are dropped through the filling tube;

said boot being of a flexible material and being flattened as a cross-seam is formed at the end of the tube with the boot filling the inside of the tube to provide a protective layer therein.

* * * * *